US006704950B1

(12) United States Patent
Johnson

(10) Patent No.: US 6,704,950 B1
(45) Date of Patent: Mar. 16, 2004

(54) CONVERTIBLE CRIB AND BED SYSTEM

(76) Inventor: Julie N. Johnson, P.O. Box 174, Argyle, MN (US) 56713

( * ) Notice: Subject to any disclaimer, the term of this patent is extended or adjusted under 35 U.S.C. 154(b) by 0 days.

(21) Appl. No.: 10/437,489

(22) Filed: May 13, 2003

(51) Int. Cl.[7] ..... A47D 7/00
(52) U.S. Cl. ..... 5/93.2; 5/425; 5/512
(58) Field of Search ..... 5/93.2, 93.1, 424, 5/425, 512, 513

(56) References Cited

U.S. PATENT DOCUMENTS

| | | | | | |
|---|---|---|---|---|---|
| 1,092,298 | A | * | 4/1914 | Schwarz | 5/513 |
| 1,926,220 | A | * | 9/1933 | Xiques | 5/95 |
| 2,231,381 | A | * | 2/1941 | Boehmcke | 5/95 |
| 2,455,340 | A | * | 11/1948 | Newman | 5/425 |
| 2,557,538 | A | * | 6/1951 | Greensfelder | 5/425 |
| 2,620,490 | A | * | 12/1952 | Bruce | 5/95 |
| 2,667,647 | A | * | 2/1954 | Reggiani | 5/95 |
| 2,839,765 | A | * | 6/1958 | Cogley | 5/425 |
| 3,703,734 | A | * | 11/1972 | Carr | 5/99.1 |
| 4,361,919 | A | | 12/1982 | Hull | 5/93 |
| 4,525,883 | A | | 7/1985 | Necowitz | 5/93 |
| 5,038,427 | A | | 8/1991 | Golden | 5/93.2 |
| 5,077,846 | A | | 1/1992 | Wheeler, III et al. | 5/93.2 |
| 5,163,190 | A | | 11/1992 | Hwang | 5/93.2 |
| 5,173,974 | A | | 12/1992 | Proano et al. | 5/93.2 |
| 5,502,849 | A | | 4/1996 | Mitchell | 5/9.1 |
| D370,364 | S | | 6/1996 | Proano et al. | D6/395 |
| 5,715,551 | A | | 2/1998 | Proano et al. | 5/93.2 |
| D391,414 | S | | 3/1998 | Proano et al. | D6/395 |
| 5,754,993 | A | | 5/1998 | Russell | 5/93.2 |
| 5,790,994 | A | | 8/1998 | Leonard | 5/53.1 |
| 2001/0049842 | A1 | | 12/2001 | Fenty et al. | 5/93.2 |

* cited by examiner

*Primary Examiner*—Teri Pham Luu
(74) *Attorney, Agent, or Firm*—Michael S. Neustel

(57) ABSTRACT

A convertible crib and bed system for converting a bed into a crib. The convertible crib and bed system includes a first partition that is attachable to a first wall, a first leg member attached to the first partition, a second leg member attached to a second wall, a pair of receiver channels within the leg members, and a second partition that is slidably received within the receiver channels. The first partition includes a support member that is secured to the wall via fasteners. The second leg member is secured to the wall also with fasteners. An adjustment structure at the base of the leg members allows for adjustment of the vertical height of the leg members. The bed is positioned beneath the first partition against the walls thereby forming a crib structure. Removing the partitions returns the bed to normal usage.

20 Claims, 5 Drawing Sheets

CONVERTIBLE CRIB AND BED SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to crib devices and more specifically it relates to a convertible crib and bed system for converting a bed into a crib.

2. Description of the Related Art

Beds have been in use for years. Typically, a bed is comprised of a support frame with a mattress positioned upon the support frame at a desired elevation above the floor. Conventional beds are not suitable for infants since they do not have any structure for retaining the infant upon the mattress.

Conventional cribs have also been in use for years. A conventional crib is comprised of a support frame similar to a conventional bed except at a higher elevation. A conventional crib also has four side walls for retaining the baby upon the small mattress positioned within the crib. The main problem with conventional cribs is that they are relatively expensive and have no practical use once the infant has outgrown the crib. Hence, the caregivers are forced to purchase a new bed frame and bed mattress for the child which is also expensive.

Examples of patented devices (or attempted to be patented) which may be related to the present invention include U.S. Pat. No. 5,790,994 to Leonard; U.S. Pat. No. 4,361,919 to Hull; U.S. Pat. No. 4,525,883 to Necowitz; U.S. Pat. No. 5,038,427 to Golden; U.S. Pat. No. 5,502,849 to Mitchell; U.S. patent application Ser. No. 2002/0,049,842 filed by Fenty et al.; U.S. Pat. No. 5,754,993 to Russell; U.S. Pat. No. D391,414 to Proano et al.; U.S. Pat. No. 5,173,974 to Proano et al.; U.S. Pat. No. 5,077,846 to Wheeler, III et al.; U.S. Pat. No. D370,364 to Proano et al.; U.S. Pat. No. 5,163,190 to Hwang; and U.S. Pat. No. 5,715,551 to Proano et al.

While these devices may be suitable for the particular purpose to which they address, they are not as suitable for converting a bed into a crib. Conventional cribs do not allow for the conversion to a conventional bed after the baby has outgrown the crib.

In these respects, the convertible crib and bed system according to the present invention substantially departs from the conventional concepts and designs of the prior art, and in so doing provides an apparatus primarily developed for the purpose of converting a bed into a crib.

BRIEF SUMMARY OF THE INVENTION

In view of the foregoing disadvantages inherent in the known types of beds and cribs now present in the prior art, the present invention provides a new convertible crib and bed system construction wherein the same can be utilized for converting a bed into a crib.

The general purpose of the present invention, which will be described subsequently in greater detail, is to provide a new convertible crib and bed system that has many of the advantages of the beds and cribs mentioned heretofore and many novel features that result in a new convertible crib and bed system which is not anticipated, rendered obvious, suggested, or even implied by any of the prior art beds and cribs, either alone or in any combination thereof.

To attain this, the present invention generally comprises a first partition that is attachable to a first wall, a first leg member attached to the first partition, a second leg member attached to a second wall, a pair of receiver channels within the leg members, and a second partition that is slidably received within the receiver channels. The first partition includes a support member that is secured to the wall via fasteners. The second leg member is secured to the wall also with fasteners. An adjustment structure at the base of the leg members allows for adjustment of the vertical height of the leg members. The bed is positioned beneath the first partition against the walls thereby forming a crib structure. Removing the partitions returns the bed to normal usage.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a convertible crib and bed system that will overcome the shortcomings of the prior art devices.

A second object is to provide a convertible crib and bed system for converting a bed into a crib.

Another object is to provide a convertible crib and bed system that allows for efficient and economical usage of a bed-crib structure.

An additional object is to provide a convertible crib and bed system that allows for easy conversion from a crib structure to a bed structure when the baby outgrows the crib.

A further object is to provide a convertible crib and bed system that retains the same mattress for a child transitioning from a crib to a bed thereby reducing the amount of adjustment required.

Another object is to provide a convertible crib and bed system that may be utilized with respect to various sizes of beds including but not limited to twin size, queen size, full size and king size.

A further object is to provide a convertible crib and bed system that can be adjusted for beds of various heights.

Another object is to provide a convertible crib and bed system that is easy to install.

An additional object is to provide a convertible crib and bed system that reduces the need to purchase additional beds.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
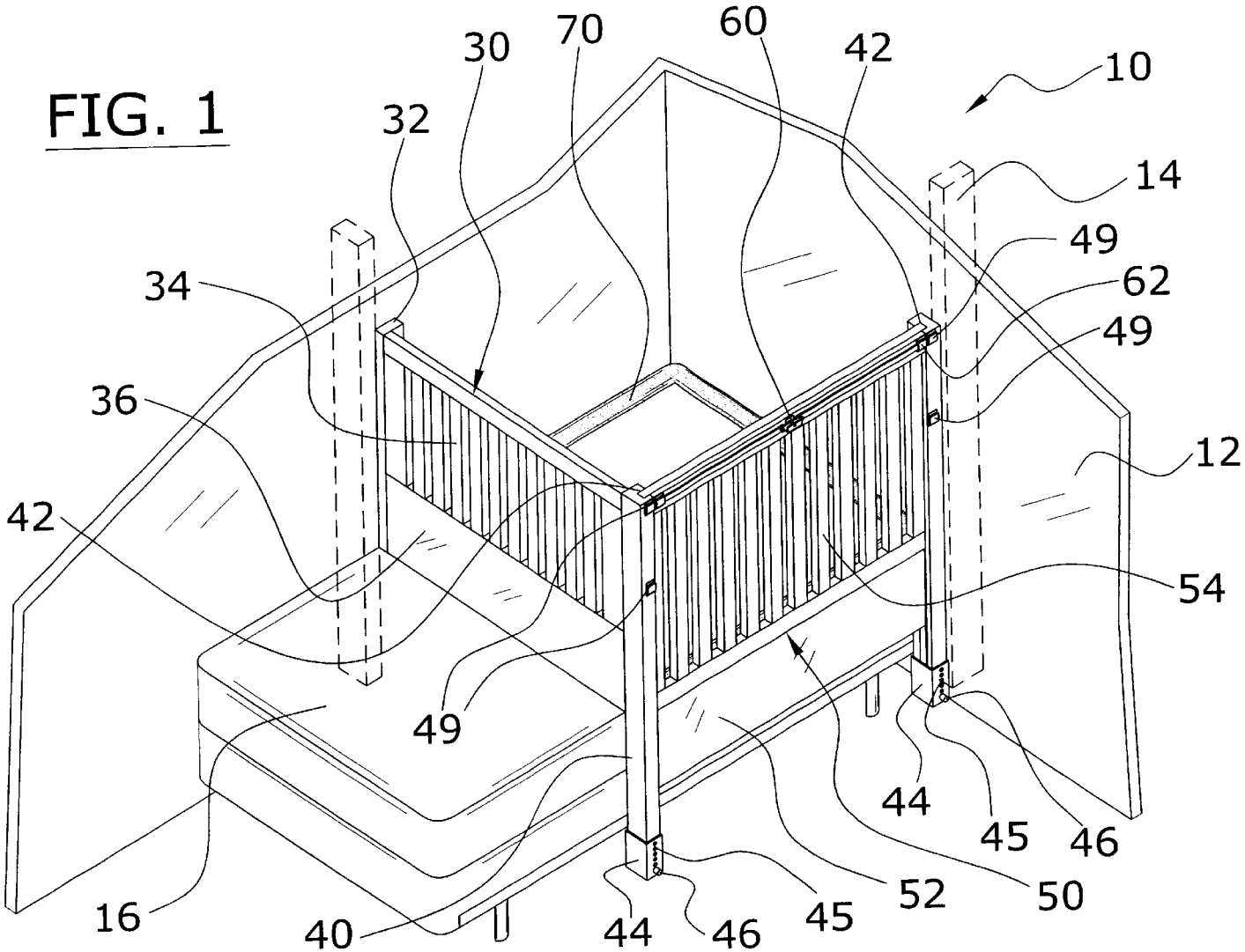
FIG. 1 is an upper perspective view of the present invention attached to the walls of a room about a bed.

Turning now descriptively to the drawings, in which similar reference characters denote similar elements throughout the several views, FIGS. 1 through 5 illustrate a convertible crib and bed system 10, which comprises a first partition 30 that is attachable to a first wall 12, a first leg member attached to the first partition 30, a second leg member attached to a second wall 12, a pair of receiver channels 42 within the leg members 40, and a second partition 50 that is slidably received within the receiver channels 42. The first partition 30 includes a support member 32 that is secured to the wall 12 via fasteners. The second leg member is secured to the wall 12 also with fasteners. An adjustment structure at the base of the leg members 40 allows for adjustment of the vertical height of the leg members 40. The bed 16 is positioned beneath the first partition 30 against the walls 12 thereby forming a crib structure. Removing the partitions returns the bed 16 to normal usage.

The first partition 30 is comprised of a broad structure as best shown in FIG. 1 of the drawings. The first partition 30 is sufficient in size to be positioned upon the upper surface of the bed 16 and provide adequate height to prevent an infant from accidentally climbing over the upper edge of the first partition 30.

Figure 5:
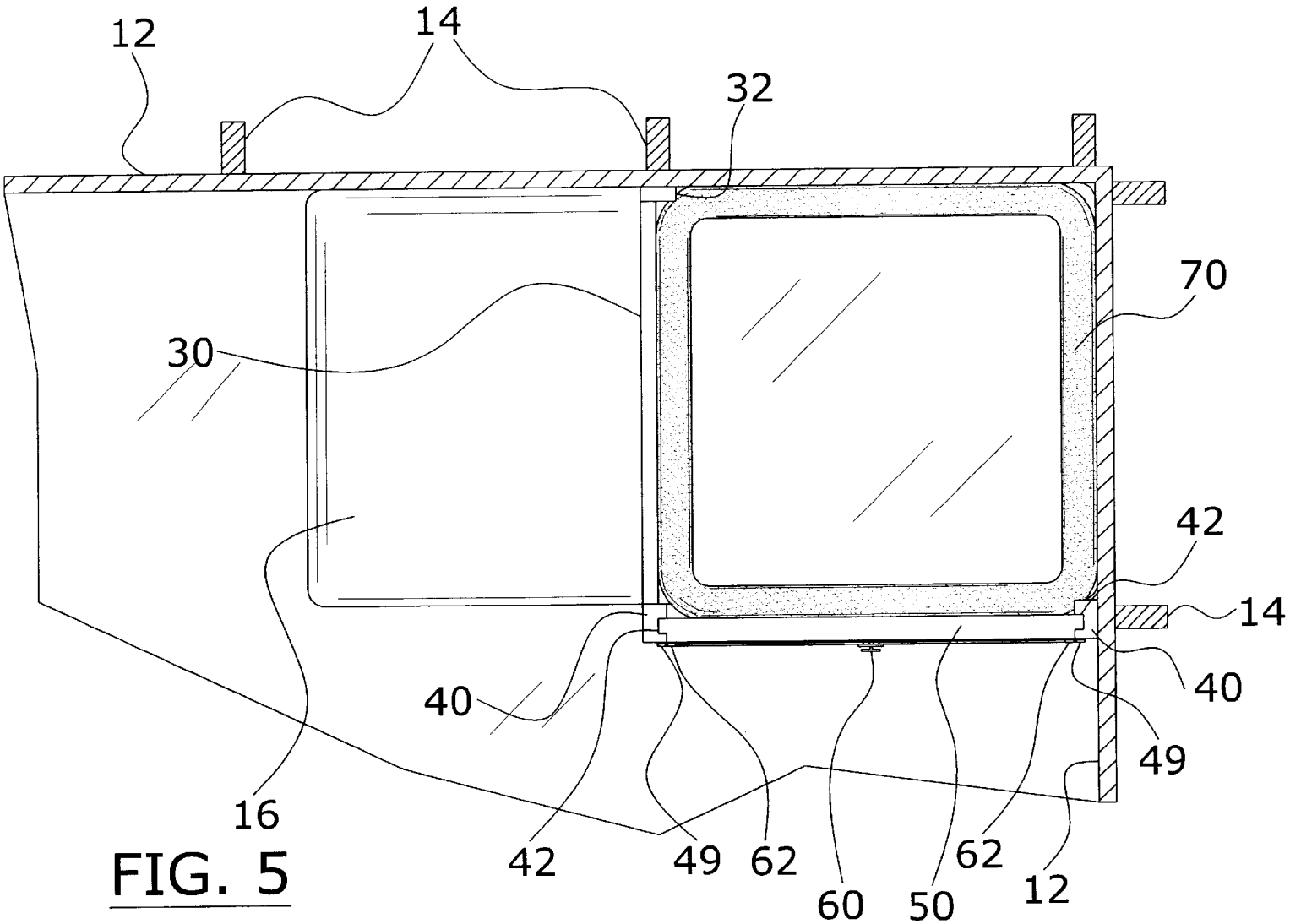
FIG. 5 is a top view of the present invention attached to the walls of a room about a bed.

The first partition 30 is transversely attached to a first wall 12 with conventional fasteners as shown in FIGS. 1 and 5 of the drawings. The first partition 30 is preferably attached directly to a stud 14 within the first wall 12, however the first partition 30 may be attached to other locations within the wall 12 with the appropriate fasteners. The first partition 30 preferably has a support member 32 that extends vertically along an edge of the first partition 30 for securing to the first wall 12. Alternatively, a broad bracket structure may be attached to the first partition 30 which provides a greater width to secure to the studs 14 in a situation where the first partition 30 is not aligned with a stud 14 in the first wall 12.

The first partition 30 preferably includes a lower support 36 that is positioned adjacent to the upper surface of the bed 16. The lower support 36 is preferably comprised of a solid structure as shown in FIG. 1 of the drawings, however the lower support 36 may have various other structures. A plurality of first bars 34 extend upwardly from the lower support 36 to an upper rail of the first partition 30 as further shown in FIG. 1 of the drawings.

The first partition 30 preferably includes a first leg member for supporting the first partition 30 above the upper surface of the bed 16 as shown in FIG. 1 of the drawings. The first partition 30 is attached to the side of the first partition 30 opposite of the first wall 12 as further shown in FIG. 1 of the drawings. The first leg member extends substantially vertically and preferably includes a receiver channel 42 facing transverse with respect to the first partition 30.

A second leg member is transversely attached to a second wall 12 with conventional fasteners as shown in FIGS. 1 and 5 of the drawings. The second leg member is positioned on the outside of the bed 16, wherein the bed 16 is positioned within a corner of a room adjacent the first wall 12 and the second wall 12. The second wall 12 is preferably substantially orthogonal with respect to the first wall 12 as shown in FIG. 1 of the drawings, however the present invention may be utilized within rooms without an right-angle corner structure as shown in FIG. 1.

The second leg member preferably includes a receiver channel 42 in opposition to the receiver channel 42 within the first leg member as shown in FIG. 1 of the drawings. A second partition 50 is slidably received within the receiver channel 42 of the leg members 40. The first partition 30 and the second partition 50 are preferably substantially orthogonal with respect to one another as best illustrated in FIG. 5 of the drawings. The first partition 30, the second partition 50, the first wall 12 and the second wall 12 define a rectangular crib area as best illustrated in FIGS. 1 and 5 of the drawings.

Figure 2:
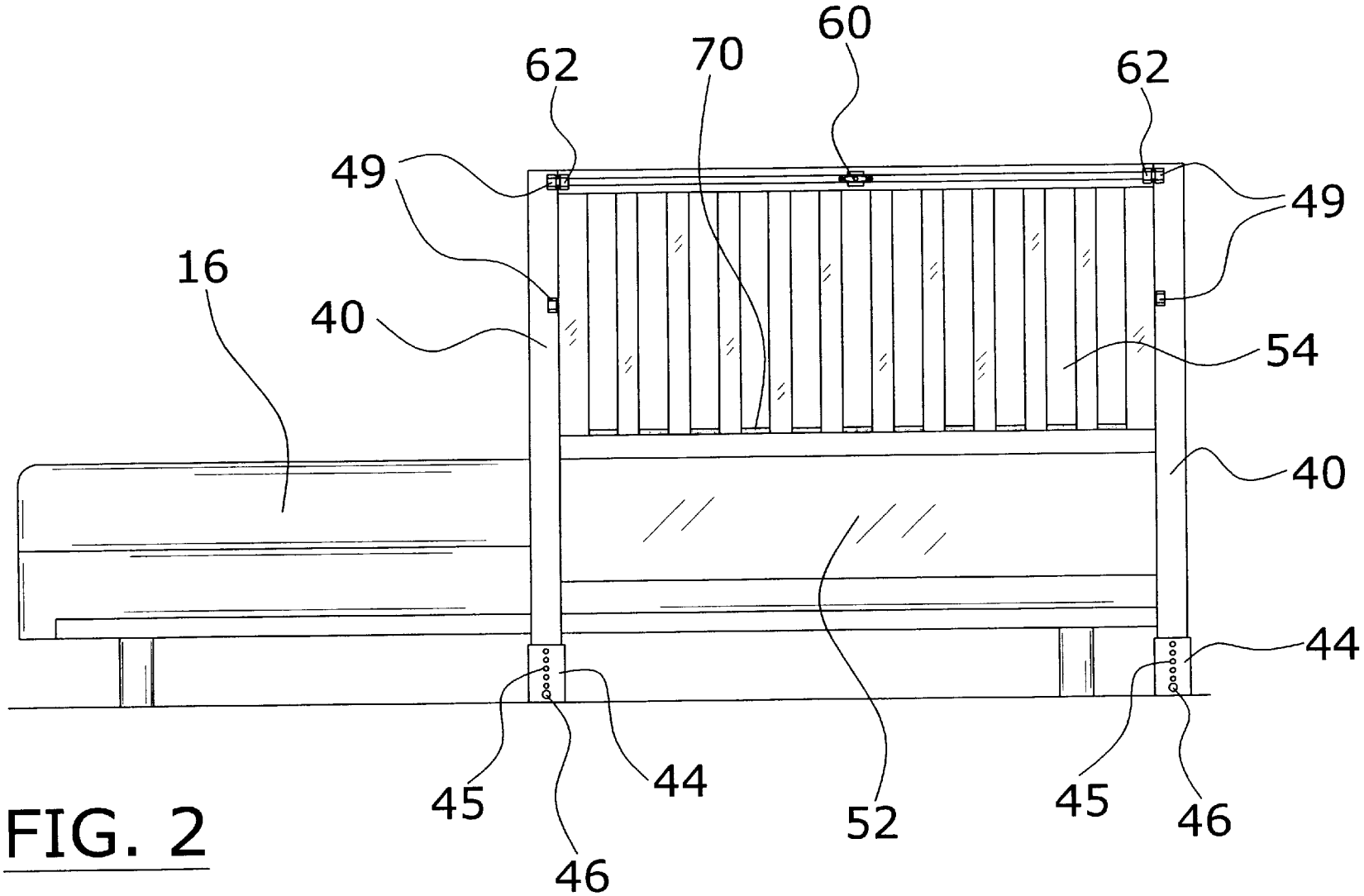
FIG. 2 is a side view of the present invention attached to the walls of a room about a bed.
Figure 3:
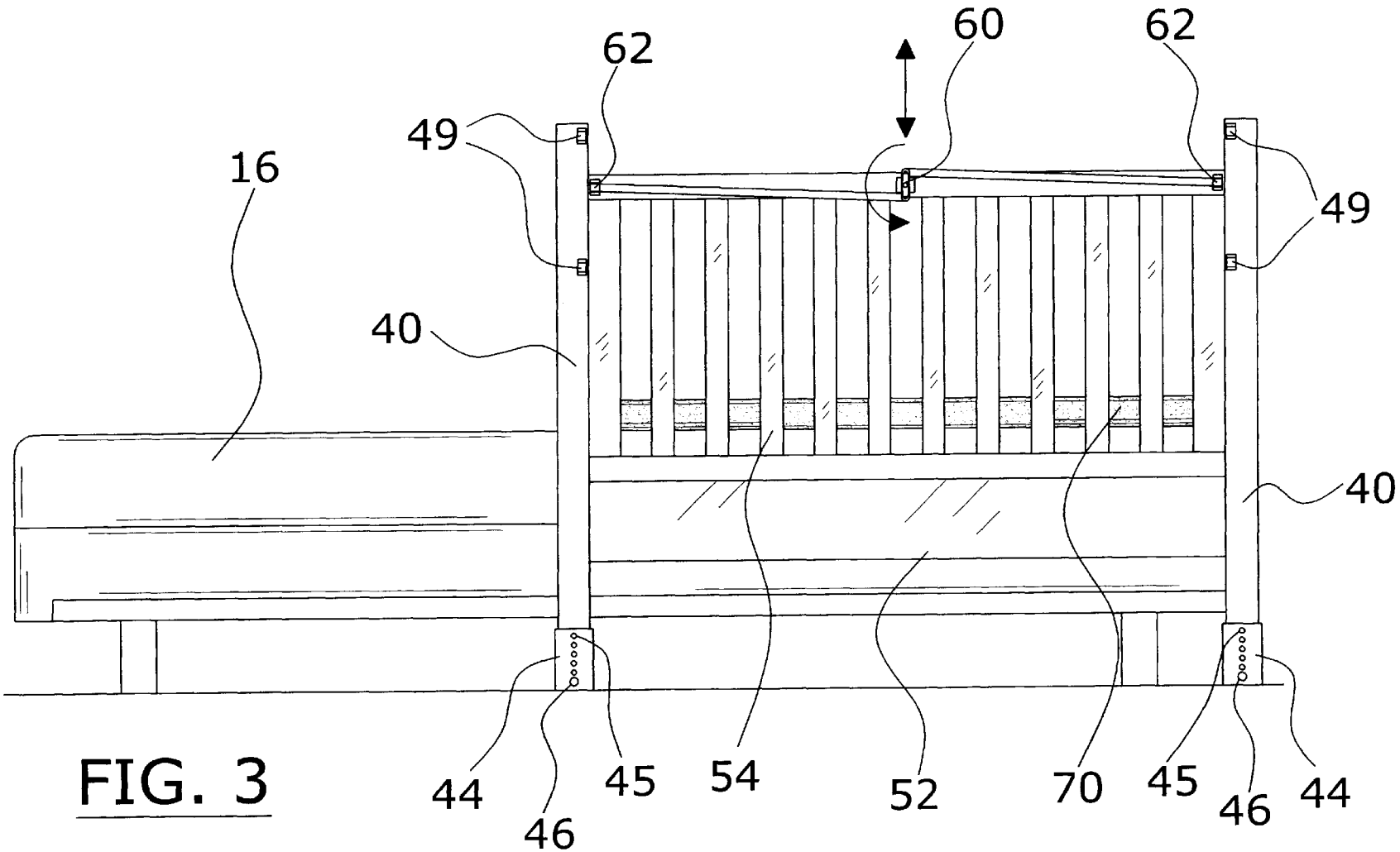
FIG. 3 is a side view of the present invention attached to the walls of a room about a bed with the second partition partially lowered.
Figure 4:
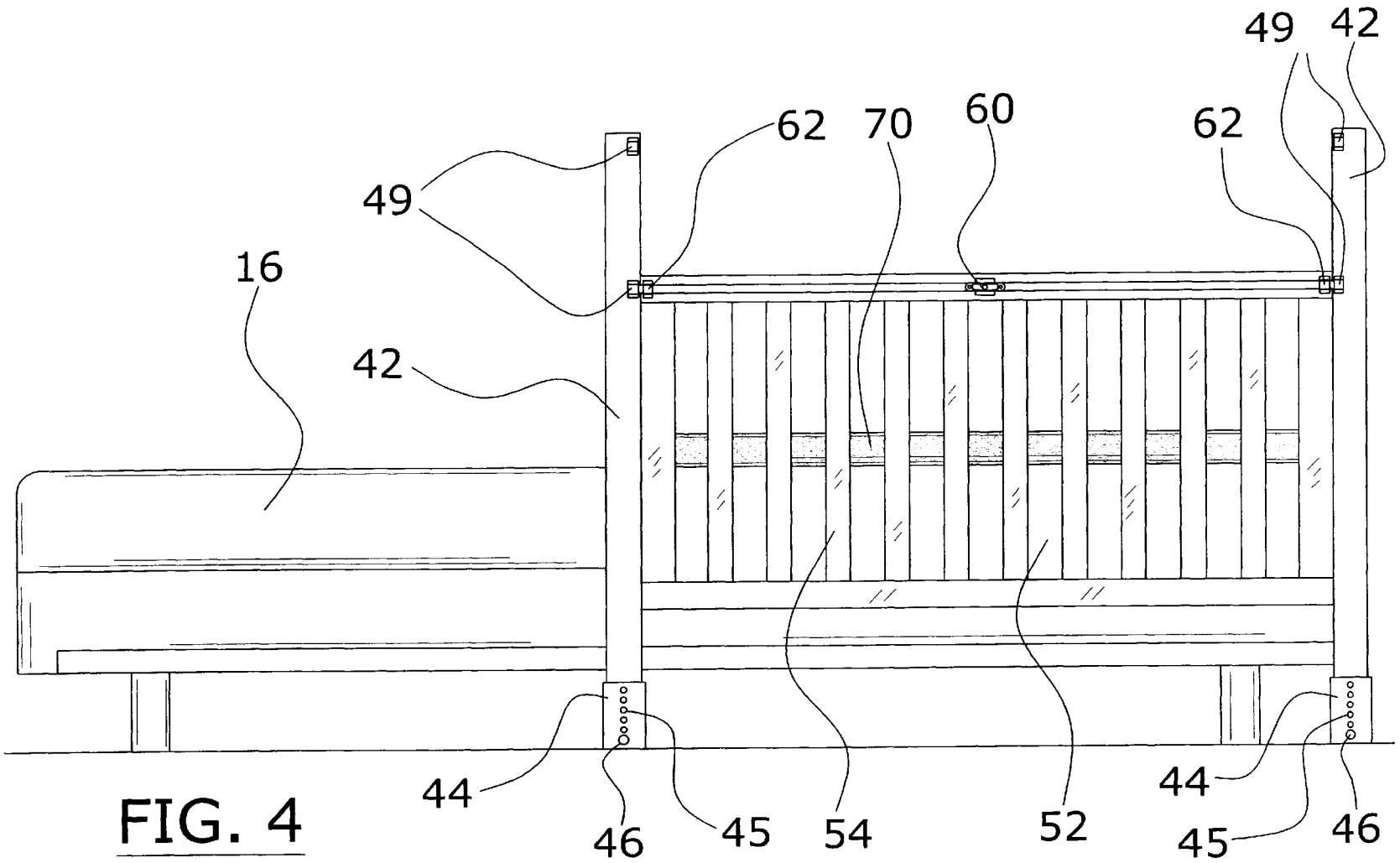
FIG. 4 is a side view of the present invention attached to the walls of a room about a bed with the second partition fully lowered.

The second partition 50 preferably includes a plurality of second bars 54 extending vertically between an upper member and a lower member of the second partition 50 as best illustrated in FIGS. 2, 3 and 4 of the drawings. As further shown in FIGS. 2, 3 and 4 of the drawings, a lower structure 52 is preferably attached between the first leg member and the second leg member wherein the lower structure 52 is comprised of a solid structure adjacent to the outer edge of the bed 16 to prevent the infant from falling between the second partition 50 and the bed 16.

A latch unit 60 is attached to the second partition 50 for selectively retaining the second partition 50 at a desired height. A plurality of receiver members 49 attached to the leg members 40 that selectively receive latch members 62 from the latch unit 60 as best shown in FIGS. 2, 3 and 4 of the drawings. Various other latching structures may be utilized to adjustable secure the second partition 50 within the leg members 40.

An adjustment structure is attached to a lower end of each of the leg members 40 that allows for adjustment of a vertical height of the leg members 40 to accommodate beds 16 of various heights. The adjustment structure is preferably comprised of a support base 44 that receives the leg members 40 as best shown in FIGS. 2, 3 and 4 of the drawings. A plurality of support apertures 45 extend within the support base 44 and receive a locking member 46. The locking member 46 selectively extends through one of the selected plurality of support apertures 45 to engage the leg members 40 at a desired height, thereby assisting in supporting the first partition 30 and the second partition 50 at a desired height.

A protective member 70 is preferably positioned around an outer lower perimeter of the crib area adjacent to the upper surface of the bed 16 to prevent the infant from being injured as best illustrated in FIGS. 1 and 5 of the drawings. The protective member 70 is preferably comprised of a resilient foam rubber material, however various other materials and structures may be utilized to construct the protective member 70.

It can be appreciated that the bed 16 and bed frame may be purchased separate of the present invention. In addition, the bed 16 and bed frame may have various heights and sizes such as but not limited to twin size, queen size, full size and king size.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A convertible crib and bed system, comprising:

a first partition attachable to a first wall, wherein said first partition includes a first leg member and wherein said first partition is elevated to allow a bed to be positioned beneath thereof;

a second leg member attachable to a second wall;

a pair of receiver channels within said leg members; and a second partition that is slidably received within said receiver channels.

2. The convertible crib and bed system of claim 1, wherein said first partition includes a support member opposite of said first leg member that is secured to said wall via fasteners.

3. The convertible crib and bed system of claim 1, including an adjustment structure attached to a lower end of each of said leg members that allows for adjustment of a vertical height of said leg members.

4. The convertible crib and bed system of claim 3, wherein said adjustment structure is comprised of a support base that receives said leg members, a plurality of support apertures within said support base, and a locking member extending through one of said plurality of support apertures to engage said leg members.

5. The convertible crib and bed system of claim 1, wherein said first partition and said second partition are orthogonal with respect to one another.

6. The convertible crib and bed system of claim 1, wherein said first partition includes a lower support and a plurality of first bars extending upwardly from said lower support to an upper rail.

7. The convertible crib and bed system of claim 1, wherein said second partition includes a plurality of second bars extending vertically between an upper member and a lower member.

8. The convertible crib and bed system of claim 7, including a lower structure attached between said first leg member and said second leg member.

9. The convertible crib and bed system of claim 1, including a latch unit attached to said second partition for selectively retaining said second partition at a desired height.

10. The convertible crib and bed system of claim 9, including a plurality of receiver members attached to said leg members that selectively receive latch members from said latch unit.

11. A convertible crib and bed system, comprising:

a first partition transversely attached to a first wall, wherein said first partition includes a first leg member and wherein said first partition is elevated above an upper surface of a bed;

a second leg member transversely attached to a second wall, wherein said second wall is substantially orthogonal with respect to said first wall;

wherein said first partition, said second partition, said first wall and said second wall define a rectangular crib area;

a pair of receiver channels within said leg members;

a second partition that is slidably received within said receiver channels; and a protective member positioned around an outer perimeter of said crib area adjacent to said upper surface of said bed.

12. The convertible crib and bed system of claim 11, wherein said first partition includes a support member opposite of said first leg member that is secured to said wall via fasteners.

13. The convertible crib and bed system of claim 11, including an adjustment structure attached to a lower end of each of said leg members that allows for adjustment of a vertical height of said leg members.

14. The convertible crib and bed system of claim 13, wherein said adjustment structure is comprised of a support base that receives said leg members, a plurality of support apertures within said support base, and a locking member extending through one of said plurality of support apertures to engage said leg members.

15. The convertible crib and bed system of claim 11, wherein said first partition and said second partition are orthogonal with respect to one another.

16. The convertible crib and bed system of claim 11, wherein said first partition includes a lower support and a plurality of first bars extending upwardly from said lower support to an upper rail.

17. The convertible crib and bed system of claim 11, wherein said second partition includes a plurality of second bars extending vertically between an upper member and a lower member.

18. The convertible crib and bed system of claim 17, including a lower structure attached between said first leg member and said second leg member.

19. The convertible crib and bed system of claim 11, including a latch unit attached to said second partition for selectively retaining said second partition at a desired height.

20. The convertible crib and bed system of claim 19, including a plurality of receiver members attached to said leg members that selectively receive latch members from said latch unit.

* * * * *